US008348268B2

(12) United States Patent
Urban et al.

(10) Patent No.: US 8,348,268 B2
(45) Date of Patent: Jan. 8, 2013

(54) APPARATUS FOR TRANSITIONING MEDIA SHEETS IN A PRINTER

(75) Inventors: Carl Thomas Urban, Portland, OR (US); David B. Schaefer, Portland, OR (US); Rob Huala, Tualatin, OR (US)

(73) Assignee: Xerox Corporation, Norwalk, CT (US)

( * ) Notice: Subject to any disclaimer, the term of this patent is extended or adjusted under 35 U.S.C. 154(b) by 368 days.

(21) Appl. No.: 12/365,954

(22) Filed: Feb. 5, 2009

(65) Prior Publication Data

US 2010/0194035 A1 Aug. 5, 2010

(51) Int. Cl.
*B65H 5/00* (2006.01)
*B65H 5/06* (2006.01)

(52) U.S. Cl. ..... 271/264; 271/272

(58) Field of Classification Search ..... 271/264, 271/272
See application file for complete search history.

(56) References Cited

U.S. PATENT DOCUMENTS

| | | | | |
|---|---|---|---|---|
| 4,412,734 | A | 11/1983 | Shibuya et al. | |
| 4,526,464 | A | 7/1985 | Milillo | |
| 4,614,334 | A * | 9/1986 | Henmi et al. | 271/8.1 |
| 5,191,383 | A | 3/1993 | Watanabe | |
| 6,757,506 | B2 | 6/2004 | Kahn | |
| 6,776,404 | B1 | 8/2004 | Milillo et al. | |
| 6,925,283 | B1 | 8/2005 | Mandel et al. | |
| 7,448,621 | B2 | 11/2008 | Yasumoto | |
| 7,455,291 | B2 | 11/2008 | Reeves et al. | |
| 7,556,260 | B2 * | 7/2009 | Yoshimoto et al. | 271/188 |
| 2005/0127598 | A1 * | 6/2005 | Nagura | 271/264 |
| 2005/0214028 | A1 | 9/2005 | Yasumoto | |
| 2006/0231999 | A1 * | 10/2006 | Moteki | 270/58.09 |
| 2007/0152398 | A1 * | 7/2007 | Watanabe | 271/264 |
| 2008/0296837 | A1 * | 12/2008 | Jowett et al. | 271/264 |
| 2009/0108519 | A1 * | 4/2009 | Baba | 271/264 |
| 2010/0207323 | A1 * | 8/2010 | Kumeta et al. | 271/264 |
| 2010/0254744 | A1 * | 10/2010 | Taniguchi | 400/582 |
| 2010/0301550 | A1 * | 12/2010 | Muratani | 271/264 |

FOREIGN PATENT DOCUMENTS

JP 06016267 * 1/1994

* cited by examiner

*Primary Examiner* — Patrick Cicchino
(74) *Attorney, Agent, or Firm* — Maginot, Moore & Beck, LLP

(57) ABSTRACT

A new media path includes a flexible member that cooperates with a control point for smooth transitions of media sheets along the path. The media path includes an elongated member having a first end and a second end, the elongated member having a longitudinal axis and a cross-member axis perpendicular to the longitudinal axis, the elongated member having a first surface that is non-linear in at least one of the longitudinal and cross-member axes, and a bevel on a second surface of the elongated member, the bevel being proximate to the first end of the elongated member at a predetermined distance from the first end.

17 Claims, 4 Drawing Sheets

APPARATUS FOR TRANSITIONING MEDIA SHEETS IN A PRINTER

TECHNICAL FIELD

The apparatus described below relates to guides that direct media sheets through a media path in a printer, and more particularly to guides that allow printer components and subassemblies to rotate and bidirectionally translate the media sheet without jamming the corners or edges of the media sheet against the guides.

BACKGROUND

In a typical printer, media trays store media sheets within the printer. During the printing cycle, a media transport system retrieves media sheets from a tray, routes the media through the printer to receive an image, and then ejects the media into an output tray for collection by a user. In some printers, separate media handling components or printer subassemblies perform the functions described above. For example, the printer could include a subassembly that retrieves a single media sheet from a stack of media and then transfers the sheet to another subassembly that conveys the sheet to a print head or image drum where the media sheet receives an image. In order to deliver an acceptable product to the user, each subassembly should transfer media sheets to the next subassembly without jamming or damaging the sheet.

Manufacturers refer to the junction between two printer subassemblies as a media path transition. Media path transitions include guides or baffles that position the media sheet for proper reception by the next subassembly. Typically, the guides include a surface that transfers the media sheet without jamming the edges or bending the corners. The characteristics of the guide depend on the functionality of the printer component or subassembly upon which the guide operates. For example, some subassemblies transport media in two directions, while other subassemblies rotate the media sheet. Still other subassemblies include access doors that open to allow a user to inspect the condition of the media path. Therefore, different subassemblies require different types of guides to direct media across the media path transition.

When guiding media subject to bidirectional movement, manufacturers commonly utilize wide baffle openings or "funnels," preceded by a control point. Each funnel includes two opposing surfaces that form a gradually constricting media path, thereby directing the media sheet into the control point. The control point includes an idler and drive roller pair. The idler roller rests upon the drive roller to form a nip. As the funnel directs media into the nip, the roller pair accurately directs the media sheet across the media path transition to the next printer component or subassembly. For an even greater level of accuracy, the receiving subassembly may include a second roller pair preceded by a second funnel to accept the media sheet. Wide baffle openings and control points effectively direct bidirectional media between printer subassemblies; however, printers commonly use other types of guides as well.

Another type of guide utilizes interdigitated or interlaced "fingers" to transition the media between printer subassemblies. In a typical arrangement, the output of a subassembly includes a first member that spans the width of the media path. The member includes a plurality of fingers or curved protrusions that extend away from the media path. Adjacent fingers of the first member are separated by a distance that enables the fingers on a second member to be received between the adjacent fingers of the first member. Similarly, the fingers of the first member fill spaces between adjacent fingers in the second member. Thus, the interdigitated fingers form a continuous and overlapping surface, for directing media sheets along a path. Generally, such interdigitated finger media guides work well; however, some types of interdigitated finger arrangements may present structure to rotating media that may catch corners or edges of certain types of media.

SUMMARY

A new media path includes a flexible member that cooperates with a control point for smooth transitions of media sheets along the path. The media path includes an elongated member having a first end and a second end, the elongated member having a longitudinal axis and a cross-member axis perpendicular to the longitudinal axis, the elongated member having a first surface that is non-linear in at least one of the longitudinal and cross-member axes, and a bevel on a second surface of the elongated member, the bevel being proximate to the first end of the elongated member at a predetermined distance from the first end.

The media path may be incorporated in a printer. The printer includes a drive roller coupled to an actuator, an idler roller that contacts the drive roller to form a nip that transfers a media sheet through the nip to a media transport apparatus having an elongated member and a pivot member, the pivot member being configured to move between a first position and a second position, and the elongated member having a first end and a second end, a longitudinal axis extending between the first end and the second end, a cross-member axis perpendicular to the longitudinal axis, a first surface that is non-linear in at least one of the longitudinal and cross-member axes, and a bevel on a second surface of the elongated member, the bevel being proximate to the first end of the elongated member at a predetermined distance from the first end to enable the first end of the elongated member to abut a media transport platform in response the pivot member being in the second position.

BRIEF DESCRIPTION OF THE DRAWINGS

Features for transitioning media sheets between printer subassemblies are discussed with reference to the drawings.

DETAILED DESCRIPTION

Figure 1A:
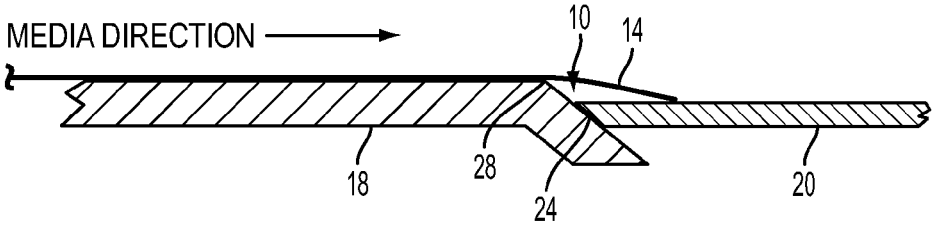
FIG. 1A is a side view of a media transport path with an interface that facilitates movement of media between subassemblies in one direction.
Figure 1B:
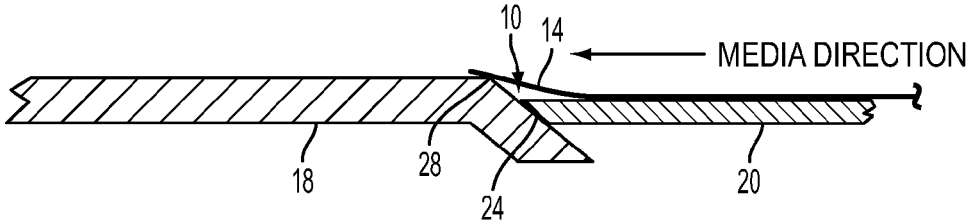
FIG. 1B is a side view of the interface of FIG. 1A shown facilitating movement of media between subassemblies in a direction opposite to that shown in FIG. 1A.

The word "printer" as used herein encompasses any apparatus, such as a digital copier, bookmaking machine, facsimile machine, multi-function machine, etc. which performs a print outputting function for any purpose. FIG. 1A depicts a portion of a media transport system at an interface 10 between printer subassemblies. The interface 10 enables media 14 to transition between printer subassemblies with reduced risk of travel interference. The interface 10 includes a guide platform 18, and a moving member 20. The moving member 20 may either translate or pivot with respect to guide platform 18 to extend the media path provided by platform 18. The bevel 24 on the platform 18 matches the bevel on the member 20. This complementary fit reduces the profile of edges, which may be present at the interface 10.

Media may move either from right to left or left to right. In the left to right direction, the leading edge of the media 14 drops from the platform 18 to the member 20 without engaging the interface 10 as the interface is positioned at a predetermined distance from the termination 28 of the platform 18. The predetermined distance is selected with reference to a curl distance. Curl distance refers to media sheets becoming curled due to the shape of some article in a printer media path. For example, curl distance may refer to the distance between the exit side of a roller pair nip and the exhibition of curl in a leading edge of the media sheet exiting the nip. A heavily curled media sheet exhibits a short curl distance, while a flat media sheet exhibits a long curl distance. In order to provide a continuous media path, the bevel of member 20 abuts platform 18 at a distance from termination 28 before media traveling left to right exhibits a curl likely to engage the interface 10. Similarly, the leading edge of media moving from right to left may strike the platform 18 below the termination 28, but the slope of the platform at interface 10 urges the media upwards onto the platform 18. The bevel in the member 20 enables the interface 10 to be restored even though the member is pivoted or translated with respect to platform 18. In a like manner, an interface 10 may be implemented at the upper surface of a media path to enable upwardly curling media to pass through subassembly interfaces without engaging movable surfaces.

Figure 2:
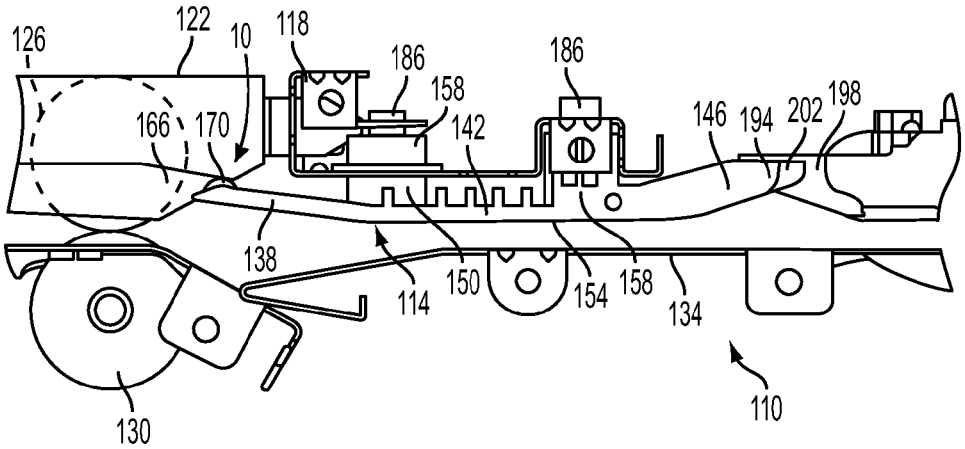
FIG. 2 depicts a side view of a media transport apparatus having an elongated member formed of a flexible material and a pivotable media path access door.

Incorporation of the interface 10 in a media path within a printer is shown in FIG. 2. The elongated member 114 includes three sections; namely, a guide arm 138, a media guide 142, and a "finger" interface 146. Each section of the elongated member may be integrated in a single structure, or each section may also be a distinct element with the elements coupled to one another. The media guide 142 may be formed of a rigid material, such as plastic. The lower surface 154 of the media guide 142 forms a gap with the media path base 134. Media travels smoothly between the lower surface 154 and the path base 134, because the lower surface 154 does not include features that present a significant risk of catching the edges of a media sheet. The upper surface 150 of the media guide 142 includes structure for attaching the upper surface 150 to the printer frame 118. In the embodiment illustrated in FIG. 2, the media guide 142 includes attachment points 158 that extend through openings in the printer frame 118.

The guide arm 138 is biased against pivot member 122, referred to herein as a media access door 122. The access door 122 includes an idler roller 126 and an inner surface 166. When the access door 122 is opened the media path is exposed. When the access door 122 is closed, the idler roller 126 contacts the drive roller 130 to form a nip between the rollers 126 and 130. Also, when the access door 122 is closed, the guide arm 38 contacts the inner surface 166 of the access door 122 to provide a continuous surface upon which the roller pair 126 and 130 can transfer a media sheet without damaging the media sheet. In particular, the tip, or first end, of the guide arm 38 contacts the inner surface 166 at a distance less than a curl distance from media exiting the nip, as explained above.

Figure 3:
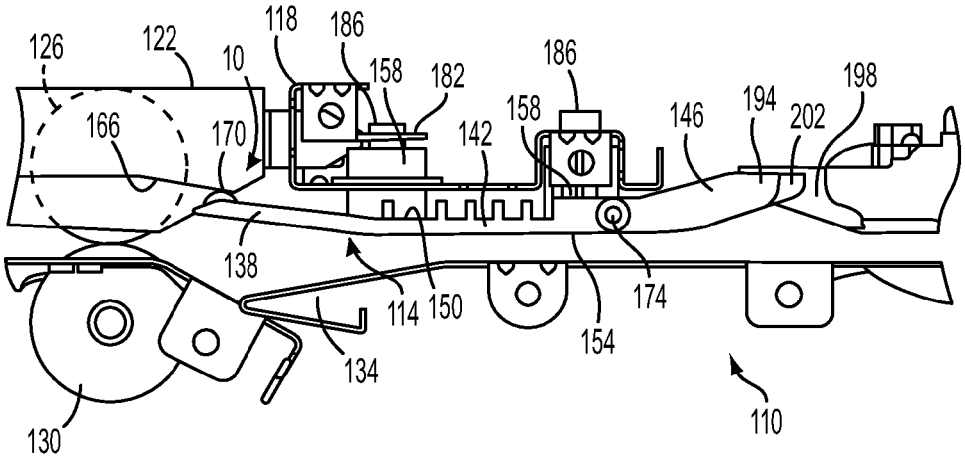
FIG. 3 depicts a side view of a media transport apparatus having an elongated member with a pivot point and a biasing member to bias the first end of the elongated member away from the media path.

In one embodiment, the guide arm 138 includes a protrusion 170 that contacts the inner surface 166 of the media access door 122, as illustrated in FIGS. 2 and 3. The protrusion 170 is made of a durable material that resists wear, but has a low coefficient of friction so that the protrusion 170 slides easily along the inner surface 166 of the access door 122. The protrusion 170 is connected to the surface of the guide arm 138 proximate the inner surface 166 of the media access door 122. In one embodiment, the protrusion 170 is a plurality of separated raised segments that collectively span the width of the guide arm 138. In another embodiment, the protrusion 170 is a single unit that spans the width of the guide arm 138.

The protrusion 170 protects the tip of the guide arm 138 from becoming worn or damaged as the outboard end of arm 138 repeatedly contacts the inner surface 166 of the media access door 122. To illustrate, as the door 122 nears the closed position, the protrusion 170 contacts the inner surface 166. The thickness of the protrusion 170 prevents the tip of the guide arm 138 from contacting the inner surface 166. As the door 122 is further closed, the pressure from the inner surface 166 upon the protrusion 170 causes the guide arm 138 to bend. The resistance offered by the guide arm 138 maintains the position of the protrusion 170 against the inner surface 166. Furthermore, as a user closes the door 122, the inner surface 66 acts on the protrusion 170 to position the tip of the guide arm 138 at a distance from the roller pair 126 and 130 less than the curl distance. The length of the guide arm 138 orients the tip of the guide arm 138 at a distance less than the curl distance from the roller pair 126 and 130 even if the access door 122 does not return exactly to the same place each time the door 122 is closed. Thus, the guide arm 138 is able to form a smooth transition surface between the media guide 142 and an access door 122 even though the access door 122 fails to close to the same position always.

To bias the tip of the guide arm 138 against the inner surface 166, the guide arm 138 may exhibit a curved and flexible profile, as illustrated in FIG. 2. In such an embodiment, when the access door 122 remains in an open position the guide arm 38 exhibits a curvature away from the path base 134. As the door 122 is closed, the protrusion 170 makes contact with the inner surface 166 before the door 122 reaches the fully closed position. As the door 122 is further closed, the inner surface 166 urges the protrusion 170 and arm 138 toward the roller pair 126 and 130 to flatten or bend the guide arm 138.

In another embodiment, as illustrated in FIG. 3, the guide arm 138 and the media guide 142 are structural elements that are distinct from the finger interface 146. In such an embodiment, the guide arm 138 and the media guide 142 include a pivot point 174 and an attachment point 158. The guide arm 138 maintains a curvature away from the path base 134; however, in this embodiment the guide arm 138 also includes a biasing member 182. The biasing member 182 is coupled between the frame 118 and the arm 138 to urge the guide arm 138 away from the path base 134 when the access door 122 is in the open position. When a user closes the access door 122, the inner surface 166 contacts protrusion 170 before the door 122 becomes fully closed. When force exerted by the user exceeds the resistive force exerted by the biasing member 182, the force from the user against the inner surface 166 causes the guide member 138 to pivot about the pivot point 174 toward the path base 134. The resistive force from the biasing member 182 keeps the protrusion 170 firmly pressed against the inner surface 166 as the user completely closes the door 122.

Figure 4:
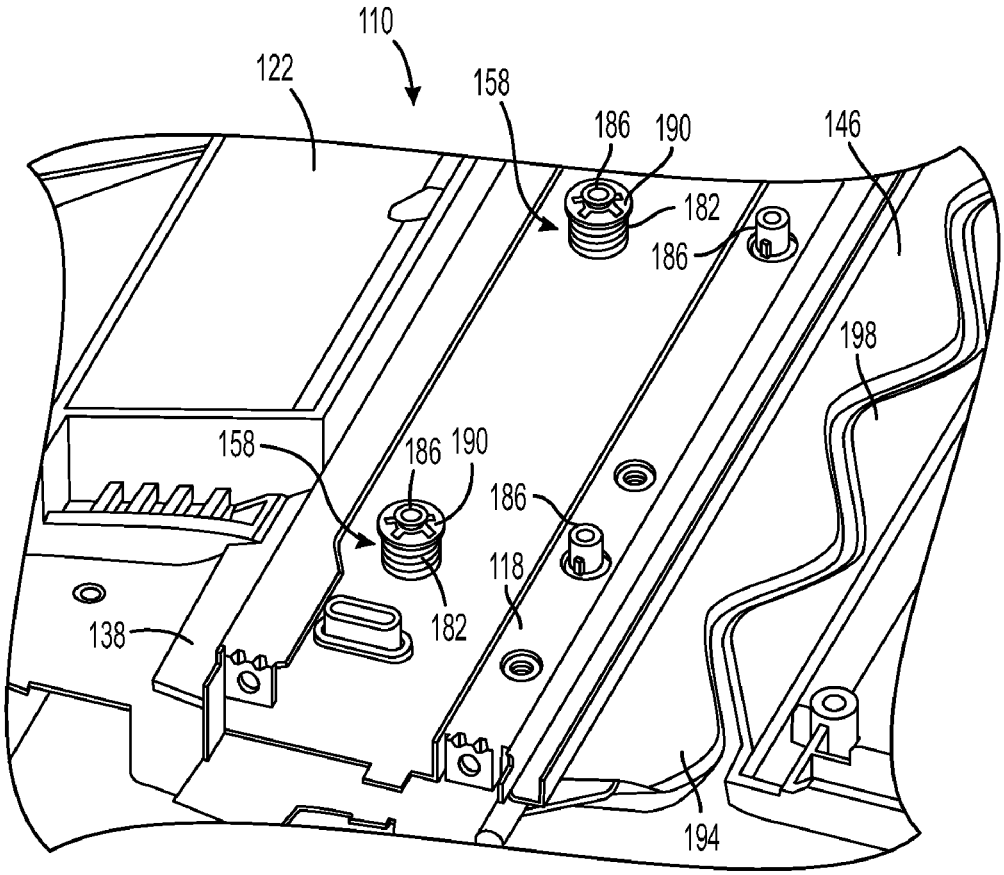
FIG. 4 depicts a perspective view of the media transport apparatus having a biasing member that includes a set of springs positioned along the second surface of the member.

The biasing member 182, as illustrated in FIG. 3, cooperates with the attachment point 158. The biasing member 182 can be any suitable device that biases the guide arm 138 away from the path base 134, such as a spring or an elastomeric member. In one embodiment, the biasing member 182 connects the attachment point 158 to the printer frame 118. As illustrated in FIG. 4, the guide arm 138 may contain a series of attachment points 158 that span the width of the guide arm 138. In such an embodiment, the attachment points 158 include posts 186 that extend through openings in the printer frame 1 18. The biasing member 182 is a spring that surrounds the post 186. The bottom of the spring is connected to the base of the attachment point 158 and the top is connected to a cap 190 upon the top of the post 186. When the access door 122 is opened, the spring contracts and pivots the guide arm 138 away from the path base 134. Of course, many other embodiments are possible that bias the guide arm 38 away from the path base 134.

At the other end of the media elongated member 114 is the finger interface 146. As illustrated in FIG. 4, the finger interface 146 contains a plurality of fingers 194 or lobes that interdigitate or interlace with a corresponding set of fingers 198 on the next printer subassembly. The finger interface 146 may be separable or integral with the media guide 142 and guide arm 138. When the finger interface 146 is a distinct element, posts 186 connect the finger interface 46 to the media guide 142 and/or printer frame 1 18. The finger interface 146 is made of a rigid material, usually plastic; however, any rigid material having a substantially smooth surface may be utilized. As explained below, the fingers 194 form a smooth transition between the media transport system 110 and the next printer subassembly.

As illustrated in FIG. 2, the lower surface of the fingers 194 is sloped away from the path base 134. The degree or curvature of the slope depends on the particular embodiment, but in most embodiments the slope should permit the lowest portion of each fingertip 202 to reside above the plane formed by the bottom surface of the fingers 198 on the next printer subassembly, as illustrated in FIGS. 2 and 3. When the fingertips 202 are above the aforementioned plane, the interdigitated fingers form a continuous surface.

Figure 5:
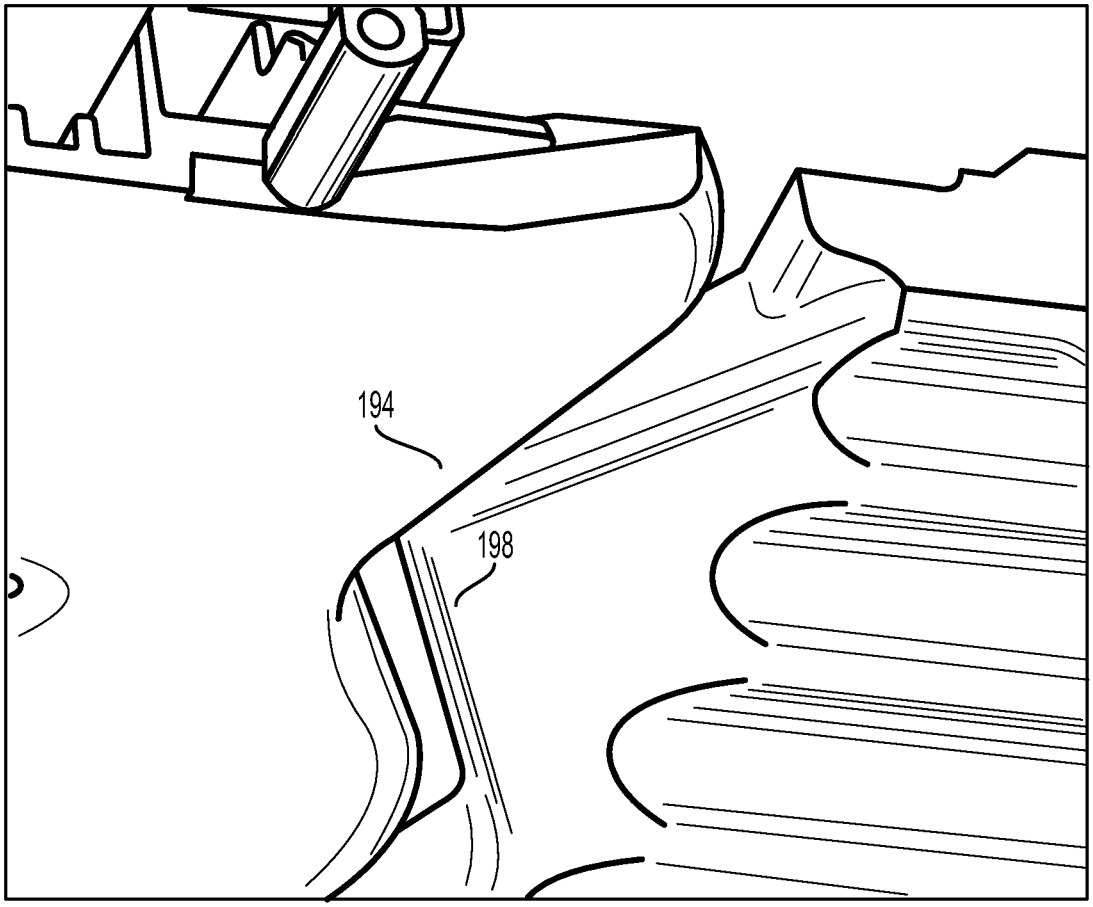
FIG. 5 depicts a perspective view of the fingers having sloped side surfaces and being interdigitated with a coordinating set of fingers.

To provide a surface even less likely to cause the edges of the media sheet to become jammed, the sides of the fingers 194 may also include a slope, as illustrated in FIG. 5. Similarly, the fingers 194 may include a partially rounded cross section. In both embodiments, the sides of the fingers 194 do not include sharp corners that present a significant risk of catching the edges of the media sheets, should the next printer subassembly rotate the media sheet. Of course, the side surfaces of the fingers 194 also permit media sheets to travel under the interdigitated fingers 194 and 198 in either the forward or reverse directions.

In operation, a media sheet enters the nip formed by the roller pair 126 and 130. The biasing member 182 or the flexible nature of the guide arm 138 positions the leading edge of the guide arm 138 less than the curl distance away from the roller pair 126 and 130. As a result, the roller pair 126 and 130 transports the media sheet toward or away from the media transport system 110 or even rotates the media sheet, because the guide arm 138 presents a smooth and continuous surface to the edges of the media sheet. Next, the roller pair 126 and 130 transports the leading edge of the media sheet in the gap formed by the media guide 142 and the media path base 134. Finally, the roller pair 126 and 130 transports the leading edge of the media sheet smoothly under the fingers 194 of the finger interface 146 and into the region of the next printer subassembly. The sloped or rounded side surfaces of the interdigitated fingers 194 and 198 permit the next printer subassembly to transport the media sheet forward or backward, and also rotate the media sheet, because the fingers 194 present guiding structure with relatively little, if any, structure that can catch the edges of the media sheet.

In response to users opening the access door 122 to inspect the condition of the media path or to clear a paper jam, the protrusion 170 interacts with the access door 122 to position the outboard end of the arm 138 so that the risk of media catching an edge is substantially reduced. The interaction of the inner surface 166 and the protrusion 170 effectively reduces the risk of media catching an edge, even though the access door 122 does not return to the same position each time it is closed. Also, the finger interface 146 allows a user to remove and install the media transport system 110 and the next printer subassembly easily, without requiring a tedious alignment of the structure forming the media path. Instead, a smooth media transition surface is provided by simply interdigitating the fingers 194 on the media transport system 110 with the fingers 198 on the next printer subassembly. Finally, even though the media transport system 110 has been illustrated in a horizontal configuration, the system 110 works equally well in other orientations.

It will be appreciated that variations of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

We claim:

1. A media path in a printer comprising:

an elongated member having a first end and a second end, the elongated member having a length and a width perpendicular to the length, the elongated member having a first surface that is non-linear along a portion of the length and the width of the elongated member, the elongated member being configured along a portion of the length of elongated arm at the first end to curve away from the media path in the printer; and a protrusion positioned at the first end of the elongated member, the protrusion being configured to bend the first end of the elongated member toward the media path to position the first end of the elongated member at a predetermined distance from a nip formed by a roller pair positioned in the media path at the first end of the elongated member in response to a pivot member directly contacting the protrusion.

2. The media path of claim 1, the second end of the elongated member further comprising:

a plurality of fingers, each of the fingers being sloped along the length of the elongated member and having at least one sloped side surface.

3. The media path of claim 1, the second end of the elongated member further comprising:

a plurality of fingers, each of the fingers being sloped along the length of the elongated member and having a partially rounded cross section along the width of the elongated member.

4. The media path of claim 1, the elongated member further comprising:

a pivot point between the first and second ends, wherein the first end pivots at a position along the length of the elongated member; and a biasing member between the first end and the pivot point that biases the first end along a portion of the length of the elongated member.

5. The media path of claim 4, the biasing member comprising:

a plurality of springs positioned along a second surface of the elongated member in a direction parallel to the width of the elongated member.

6. A media transport apparatus comprising:

an elongated member having a first end and a second end, the elongated member having a length and a width perpendicular to the length of the elongated member, the elongated member having a first surface that is non-linear along a portion of the length and the width of the elongated member and the elongated member being configured along a portion of the length of the elongated arm at the first end to curve away from a media path that is opposite the first surface of the elongated member;

a pivot member that moves between a first position and a second position; and a protrusion positioned at the first end of the elongated member, the protrusion being configured to bend the first end of the elongated member toward the media path to position the first end of the elongated member at a predetermined distance from a nip formed by a roller pair positioned in the media path at the first end of the elongated member in response to the pivot member moving from the first position to the second position to contact the protrusion directly.

7. The media transport apparatus of claim 6, the second end of the elongated member further comprising:

a plurality of fingers, each of the fingers being sloped along the length of the elongated member and having at least one sloped side surface.

8. The media transport apparatus of claim 6, the second end of the elongated member further comprising:

a plurality of fingers, each of the fingers being sloped along the length of the elongated member and having a partially rounded cross section along the width of the elongated member.

9. The media transport apparatus of claim 6 further comprising:

a first roller in the roller pair being configured to enable a portion of the first roller to extend below an inner surface of the pivot member, the first roller contacting a second roller in the roller pair to form the nip when the pivot member is in the second position; and the protrusion bending the first end of the elongated member to position the first end of the elongated member proximate the inner surface of the pivot member at a distance that is less than a curl distance from media exiting the nip.

10. The media transport apparatus of claim 9 wherein the elongated member further comprises:

a pivot point between the first and second ends, wherein the first end pivots at a position along the length of the elongated member; and a biasing member between the first end and the pivot point that biases the first end at a position along the length of the elongated member.

11. The media transport apparatus of claim 10, wherein the biasing member comprises:

a plurality of springs positioned along a second surface of the elongated member in a direction parallel to the width of the elongated member.

12. A printer for applying an image to a media sheet comprising:

a drive roller;

an idler roller that contacts the drive roller to form a nip that transfers a media sheet through the nip in a media path to a media transport apparatus having an elongated member and a pivot member, the pivot member being configured to move between a first position and a second position, and the elongated member comprising a first end and a second end, a length of the elongated member extending between the first end and the second end of the elongated member, a width of the elongated member being perpendicular to the length of the elongated member, the elongated member further comprising a first surface that is non-linear along at least one of the length and the width of the elongated member, and a protrusion positioned at the first end of the elongated member, the protrusion being configured to bend the first end of the elongated member toward the media path to position the first end of the elongated member at a predetermined distance from a nip formed by the drive roller and the idler roller in the media path in response to the pivot member moving from the first position to the second position to contact the protrusion directly.

13. The printer of claim 12, the second end of the elongated member further comprising:

a plurality of fingers, each of the fingers being sloped along the length of the elongated member and having at least one sloped side surface.

14. The printer of claim 12, the second end of the elongated member further comprising:

a plurality of fingers, each of the fingers being sloped along the length of the elongated member and having a partially rounded cross section along the width of the elongated member.

15. The printer of claim 12 further comprising:

a pivot point between the first and second ends of the elongated member, wherein the first end pivots along the length of the elongated member; and a biasing member between the first end of the elongated member and the pivot point that biases the first end of the elongated member along the length of the elongated member.

16. The printer of claim 15, the biasing member comprises:

a plurality of springs positioned along the second surface of the elongated member in a direction parallel to the width of the elongated member.

17. The printer of claim 12 wherein the protrusion is essentially comprised of a durable material having a low coefficient of friction.

* * * * *